US007484882B2

(12) United States Patent
Bhavnani

(10) Patent No.: US 7,484,882 B2
(45) Date of Patent: Feb. 3, 2009

(54) TIMING DEVICE

(75) Inventor: Dilip Bhavnani, Beverly Hills, CA (US)

(73) Assignee: Sun Coast Merchandise Corporation, Commerce, CA (US)

( * ) Notice: Subject to any disclaimer, the term of this patent is extended or adjusted under 35 U.S.C. 154(b) by 391 days.

(21) Appl. No.: 11/027,236

(22) Filed: Dec. 30, 2004

(65) Prior Publication Data

US 2006/0146653 A1 Jul. 6, 2006

(51) Int. Cl.
*G04F 1/00* (2006.01)
*G04B 23/00* (2006.01)

(52) U.S. Cl. ..... 368/98; 368/265

(58) Field of Classification Search ..... 368/89, 368/97–100, 109, 246, 257–260, 269–272, 368/265

See application file for complete search history.

(56) References Cited

U.S. PATENT DOCUMENTS 2,690,801 A * 10/1954 Perl ..... 368/97
3,648,454 A * 3/1972 Morrison ..... 368/2
3,690,021 A * 9/1972 Glass et al. ..... 434/304
4,070,820 A 1/1978 Lewinter
4,287,964 A * 9/1981 Sollenberger ..... 185/38
4,730,284 A * 3/1988 Adams ..... 368/72
4,763,898 A * 8/1988 Hemmann ..... 273/153 R
5,044,961 A * 9/1991 Bruskewitz ..... 434/304
5,058,086 A * 10/1991 Barlow ..... 368/98
5,152,422 A 10/1992 Springer
5,715,214 A 2/1998 Svarnias
5,745,441 A 4/1998 Dunsberger
5,872,746 A * 2/1999 Reiner et al. ..... 368/223
6,122,227 A * 9/2000 Kuo ..... 368/109

* cited by examiner

*Primary Examiner*—Vit W Miska
(74) *Attorney, Agent, or Firm*—The Soni Law Firm

(57) ABSTRACT

A timing device including a primary audio signal and a secondary visual signal feature which is released upon expiration of the desired time sequence and will thereupon extend outward from the timer body. The audio and visual signal features may be activated independently or simultaneously, at the user's selection. The function of this timer is also entirely mechanical, thereby rendering the device highly useful for the hearing impaired, compatible with a broad spectrum of environmental conditions, capable of long life operation and completely portable and self powered. The outer surfaces of the timing device, having relatively smooth surfaces, are well-suited for application of art work, logos and graphics for advertising and promotional purposes.

17 Claims, 3 Drawing Sheets

TIMING DEVICE

BACKGROUND OF THE INVENTION

1. Field of the Invention

The present invention relates to a visual "pop up" and audio type invention which could be used as a timing device. More specifically, the present invention relates to a device that includes a function whereby a secondary mechanism may be coordinated with a primary timing cycle such that upon expiration of the pre set interval, this secondary mechanism causes a visual signal device to protrude outward from the housing envelope of the device. This secondary mechanism may be coordinated with the primary mechanism which includes an audio signal, such as a bell. Through the inclusion of a visual signal as well as an audio signal, the timer is more conveniently used by the general public as well as by elderly and hearing impaired individuals. The secondary mechanism is selectively engaged whereby the timer may be operated with or without the secondary mechanism.

2. Description of the Prior Art

Timers are well known in the art. Conventional rotating dial type devices typically rely upon an audio signal alone, such as a bell or buzzer to alert the user of time expiration. While economical, these timers provide only a single source signal and thereby limit their use to only those individuals who are capable of full sensory perception in the aspect of the signal.

U.S. Pat. No. 4,070,820 to Lewinter describes a dual function kitchen timer which appears to have a primary and a secondary mechanism. This timer permits a user to set for two different but concurrent time periods. In this timer, however, both timing mechanisms activate a hammer bell audio signal alone when the relative time periods elapse. There is no visual or other type of secondary signal.

U.S. Pat. No. 5,745,441 to Dunsberger describes a timing device with two timing mechanisms. Again, however, each of the signaling devices is an audio signal; a clapper and a chime are described as the audio signaling devices.

More sophisticated devices do exist, however, generally these timers require electro-mechanical power, such as household electricity or a battery, to perform multifunction tasks. These timers are inherently disadvantageous in that they are costly and their reliance upon a secondary means of energization, such as batteries or electricity renders these timers useless in the event of loss of power or dead batteries.

As an example, U.S. Pat. No. 5,715,214 describes an electrical timer which can be interpreted as having dual output signaling capability. As the dial passes its desired location, an audible noise may be heard as the rotating dial probe(s) pass by the timer's inward radial extensions. As this occurs, an electrical circuit is closed, permitting electricity to flow to the female output jack located on the side of the timing device, thus facilitating a secondary signaling means. This timer is more complicated, however, as it requires an electrical outlet as its power source, limiting its portability. Moreover, it operates on a continuous cycle, such as would be used for turning on an electrical appliance or a light at the same time each day. It is not well suited for counting down a specified time interval.

Similarly, U.S. Pat. No. 5,152,422 describes a medication timer which has multiple signaling mechanisms. When a specified time interval is reached, an audio signal is activated, along with a light. Once again, however, this device requires a motorized rotating face to initiate movement toward signal activation. The description specifies a power cord for electricity to operate the clock mechanism. This device is not portable and simple to operate, such as the invention described herein.

The disadvantage of these devices is that in order to provide both an audio and a visual output signal, they require electrical power. In addition, the above referenced inventions are limited in use as they are not highly portable.

What is needed is a small and easy to use portable device which is capable of emitting both an audio and a visual output signal upon the expiration of a desired time period. Moreover, it would be highly desirable if the signals could be initiated either independently or concurrently, at the request of the user.

SUMMARY OF THE INVENTION

The present invention is a timing device which includes a primary and a secondary timing mechanism. The primary mechanism is energized through the rotation of a dial knob which initiates a controlling means, as may be embodied by a winding spring. The primary mechanism unitizes a primary shaft connected to the controlling means at its inboard end and to the dial knob at its outboard end. The controlling means is contained within an housing, with the dial knob located outside the housing and the remainder of the primary mechanism inside the housing enclosure.

A generally flat gear is axially affixed to the primary shaft and this gear meshes with a gear on the secondary shaft. In the concurrent setting mode, when the winding means is coiled, the rotation of the primary shaft and its included gear causes the meshed gear of the secondary shaft to rotate in the opposite direction. The rotation of this secondary shaft initiates and activates its secondary output signal. An embodiment of the invention would include a means by which the secondary gear may be slidably located so as to mesh with the primary gear or, alternatively, be disengaged from the primary gear. In so doing, the secondary gear, and associated secondary output signal may be initiated concurrently with the primary signal if the gears are meshed, or may be relaxed and free from energization when the primary mechanism is energized, in the case of gear disengagement.

The primary shaft gear train is typically meshed with yet another stub shaft which includes a smaller output winding gear spring. As the primary shaft nears expiration of the desired interval, a cam gear engages this smaller winding gear spring to energize the output signal means. Upon reaching the expiration of the desired interval, the cam gear's rotation releases the output winding gear spring to permit it to unwinding. A spring loaded hammer is biased against the output unwinding means in a manner such that the spring loaded hammer then repeatedly strikes a metallic surface within the housing, resulting in a ringing bell sound as the primary signaling output to alert the user of the expiration of the desired time interval.

The secondary shaft may be configured to have a curved end on its inboard end which extends inwardly toward the center of the housing cavity. This curved end is adjacent to a spring loaded lever such that when the secondary shaft is rotated by the primary gear, the curved portion of the secondary shaft is not in contact with the lever until the expiration of the timing interval. Upon expiration, the curved portion contacts the lever and applies a force upon the lever to slide the lever to a second position and thereby compress the compression spring which was biasing the lever. One plate of a set of two slidably engaged parallel plates in contact with one another is connected to the lever and when the lever is thereby slid to this second position the two plates become separated.

The second plate, which is also spring biased against the inside bottom of the housing, is then free to move. When so freed, the spring bias force upon this second plate causes it to slide radially outward with respect to the housing. A secondary output visual signal, affixed to the outboard end of this second plate is thereby also extended radially outward from the housing, and the user experiences the concurrent sounding of the primary audio output signal, and the extension from the housing of this secondary visual output signal.

DETAILED DESCRIPTION OF THE PREFERRED EMBODIMENT

Figure 1:
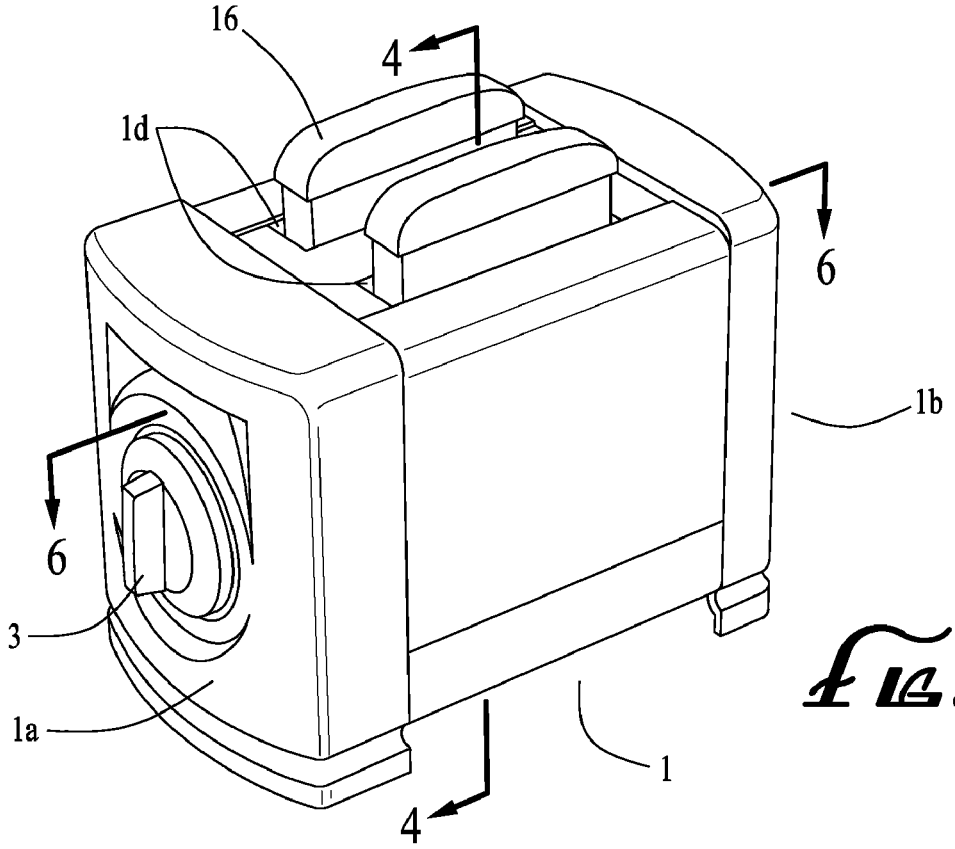
FIG. 1 is a top front perspective view of a preferred embodiment of the timing device with the secondary visual output signal in its extended position.
Figure 2:
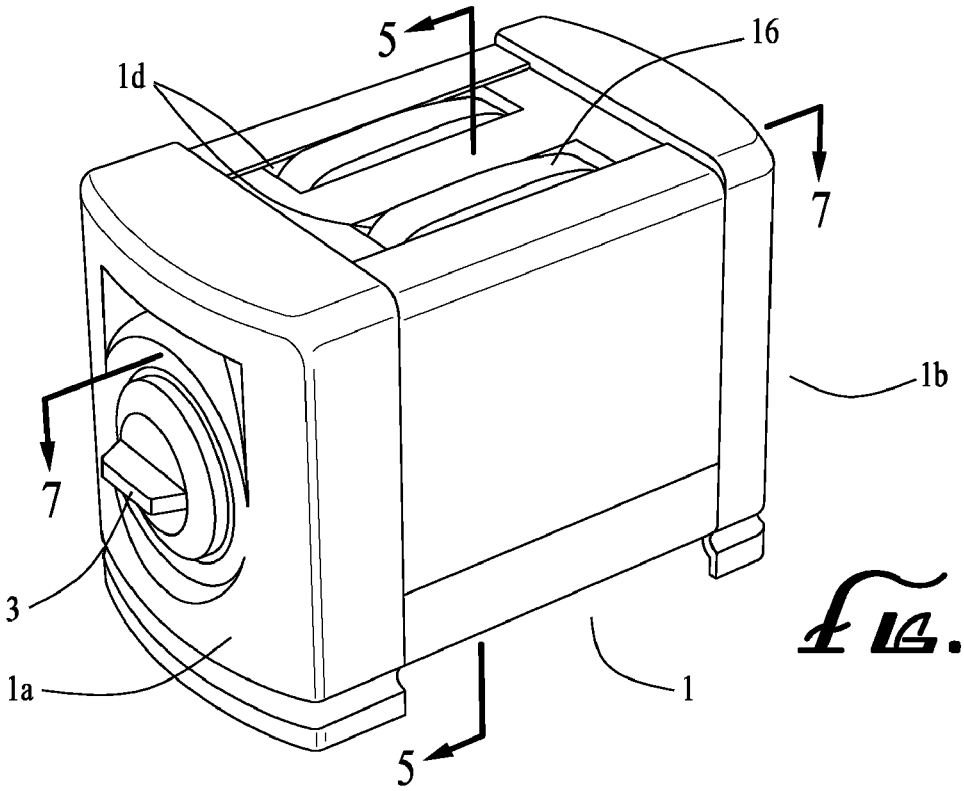
FIG. 2 is a top front perspective view of a preferred embodiment of the timing device with the secondary visual output signal in its retracted position.
Figure 3:
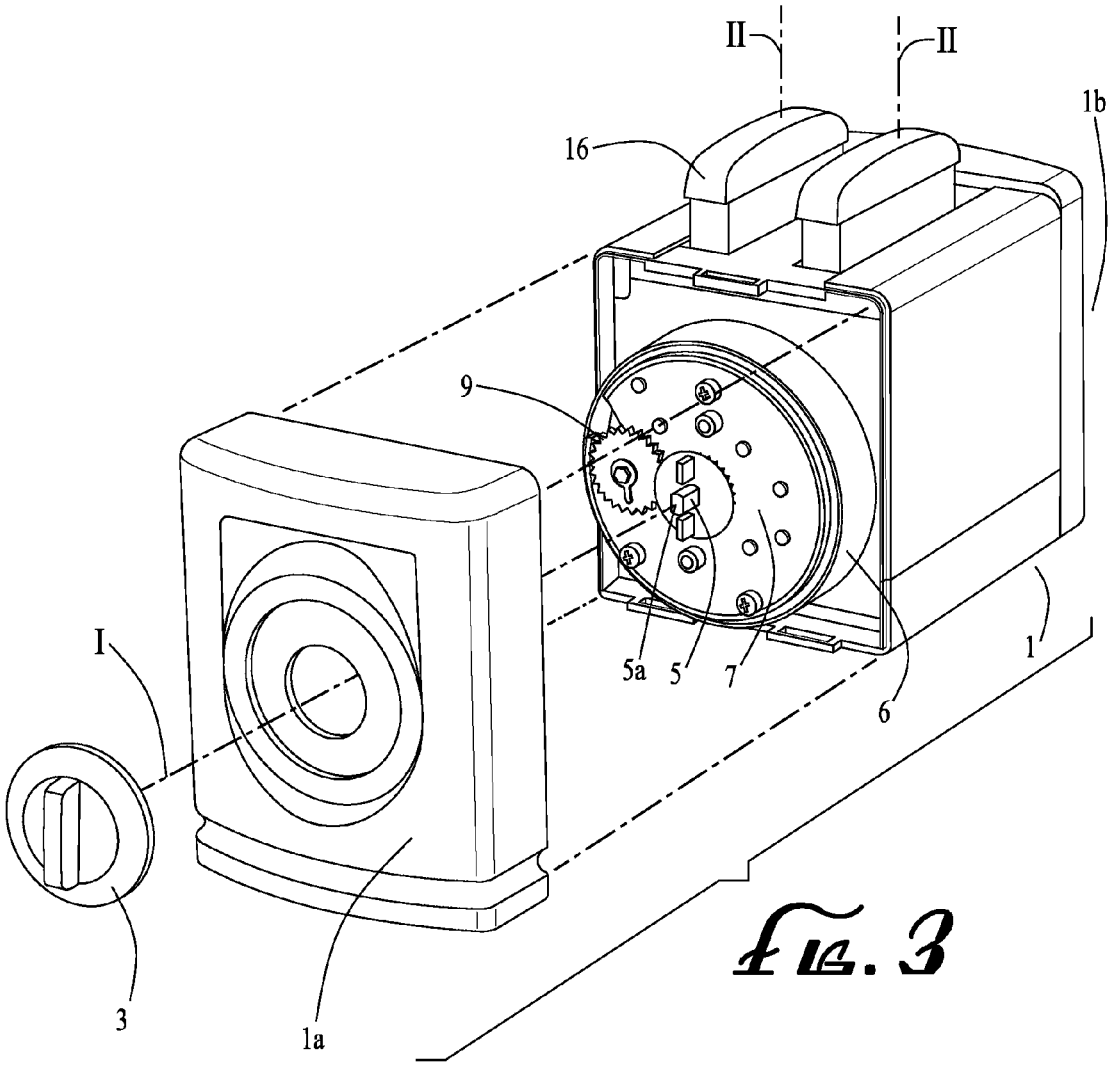
FIG. 3 is a is a top front perspective exploded view of a preferred embodiment of the timing device with the secondary visual output signal in its extended position. This figure shows the dial knob, end caps, bell housing, primary shaft and gear and the secondary shaft and gear.
Figure 6:
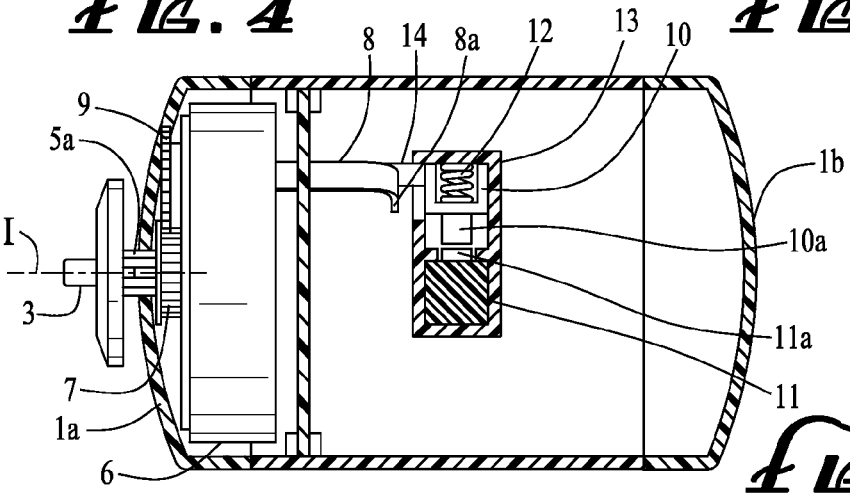
FIG. 6 is a top cross sectional view of a preferred embodiment of the timing device with the secondary visual signal in its extended position, and shows the parallel plates and wedges, compression spring and housing enclosure. The curved portion of the secondary shaft has moved the lever to compress the spring and release the parallel wedges to free the second sliding plate to extend radially outward from the housing.
Figure 7:
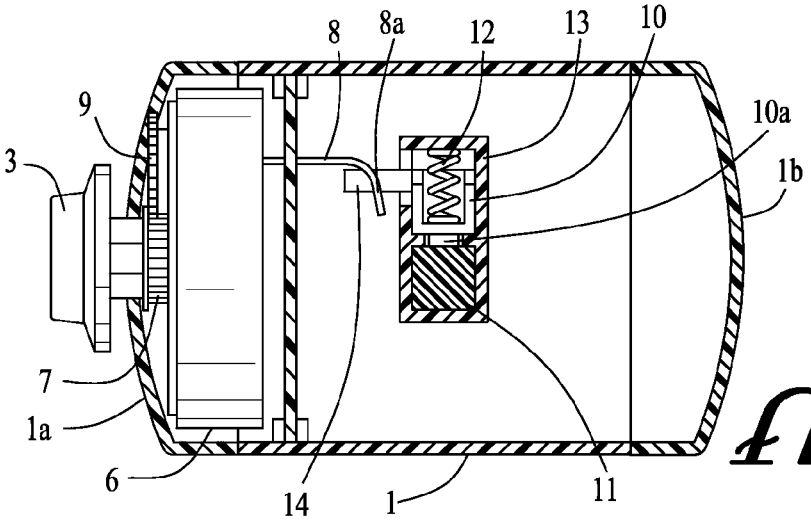
FIG. 7 is a top cross sectional view of a preferred embodiment of the timing device with the secondary visual signal in its retracted position, and shows the parallel plates and wedges, compression spring and housing enclosure. The curved portion of the secondary shaft is not in contact with the lever and the parallel wedges are engaged and the second sliding plate is maintained in its position within the housing.

Referring to FIGS. 1 and 2, in the preferred embodiment, the timing device comprises a housing 1, a dial knob 3, a timing mechanism, an audio signal generating mechanism, and a visual signal generating mechanism. The housing 1 has two end caps 1and 1*b* attached to a main housing body 1*c* generally having a configuration of a rectangular box-shaped toaster. The housing body 1*c* has at least one recess 1*d* on its top side surface that is generally perpendicular to the two end caps 1*a* and 1*b*. The dial knob 3 is affixed to a shaft 5, which belongs to the timing mechanism, so as to be rotatable about an axis 1 aligned with the primary shaft 5 as shown in FIG. 3. The dial knob 3 located outside of but resting on the surface of the first end cap 1*a*. As shown in FIGS. 3, 6 and 7, the primary shaft 5 is connected at its outboard end 5*a* to the dial knob 3 and the inboard end of the primary shaft 5 is located inside the bell housing 6. The timing mechanism except the primary shaft 5 and the audio signal generating mechanism, as detailed below, are located within the bell housing 6. The visual signal generating mechanism encased within the housing 1 comprises, in the preferred embodiment, a pop-up visual indicator 16, an operation mechanism for moving the pop-up visual indicator 16 when actuated, and an actuation mechanism for actuating the operation mechanism at the expiration of the desired time interval. The actuation mechanism includes in the preferred embodiment a primary gear 7, a secondary gear 9, and a secondary shaft 8. The primary gear 7 is axially affixed to the primary shaft 5 and resides outside the bell housing 6. Inside the bell housing 6, the inboard end of the primary shaft 5 is attached to other members of the timing mechanism, of a type well known to those skilled in the art, which typically include a winding spring connected to and axially affixed to the primary shaft 5. The secondary shaft 8 is generally parallel to the primary shaft 5 and coupled to the secondary gear 9, which may be selectively meshed with the primary gear 7. If the secondary and primary gears are meshed, rotation of the dial knob 3 rotates the primary shaft 5 and concurrently, the primary gear 7 and secondary gear 9. Such a rotation of the dial knob 3, with the primary and secondary gears 7 and 9 meshed, will serve to energize both the audio signal generating mechanism and visual signal generating mechanism by causing the winding spring, which is mechanically coupled to the dial knob 3 via the primary shaft 5, to wind thereby storing kinetic energy.

The user of the timing device rotates the dial knob 3 to a desired position corresponding to the desired time interval. The timing mechanism then serves to unwind the winding spring a rate such that it will be relaxed and unwound upon expiration of the desired time interval. Such timing mechanism and unwinding sequence are well known to those skilled in the art. The audio signal generating mechanism comprises a second smaller winding spring, a cam gear affixed to the primary shaft 5, and a spring loaded hammer. As the winding spring begins to reach its fully relaxed unwound state, the cam gear of the primary shaft engages the second smaller winding spring to then energize the second smaller winding spring by its winding as the main winding spring continues to unwind to its relaxed position. At the point of relaxed position, the cam gear is disengaged from the second smaller winding spring which permits the second smaller winding spring to unwind. As it unwinds, the spring loaded hammer connected to the second smaller winding spring repeatedly strikes the inside diameter of the bell housing 6, resulting in a ringing tone. This tone is the audio signal in the preferred embodiment. Such an audio signal generating mechanism as described above is well known to those skilled in the art.

When the primary gear 7 is meshed with the secondary gear 9, the secondary shaft 8 will rotate concurrently with the primary shaft 5, but in the opposite direction of rotation. As shown in FIGS. 6 and 7, the secondary shaft 8 in the preferred embodiment has a generally flat cross section with a curved end 8*a* at its inboard end. During the unwinding cycle of the timing mechanism, the curved end 8*a* rotates freely and does not contact the operation mechanism inside the housing 1, which is to be described below.

Figure 4:
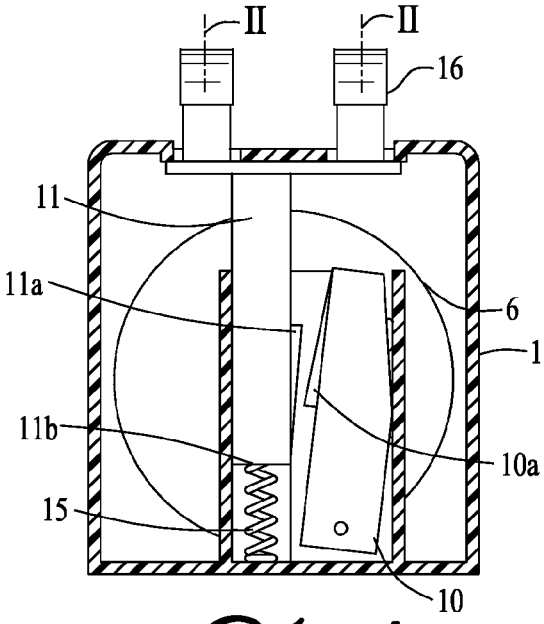
FIG. 4 is an end cross sectional view of a preferred embodiment of the timing device with the secondary visual signal in its retracted position, and shows the parallel plates and wedges, compression spring and housing enclosure.
Figure 5:
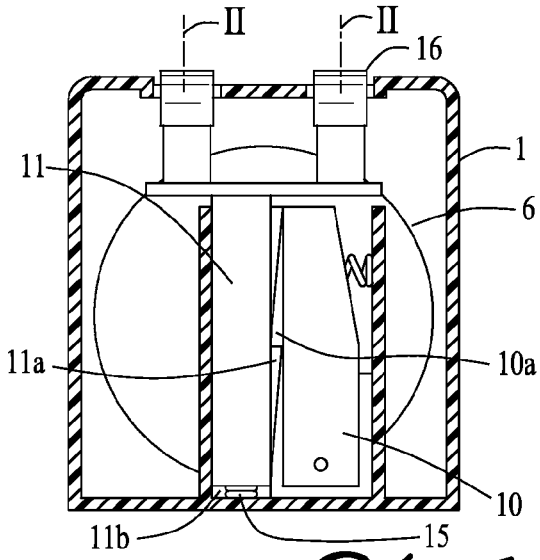
FIG. 5 is an end cross sectional view of a preferred embodiment of the timing device with the secondary visual signal in its extended position, and shows the parallel plates and wedges, compression spring and housing enclosure.

The operation mechanism of the visual signal generating mechanism, which extends the pop-up visual indicator 16 out of or retracts it into the recess 1*d*, includes a first pivoting plate 10 and a second extending plate 11. In the retracted position, the pivoting plate 10 and extending plate 11 are generally parallel to one another and each plate has a parallel wedge profile 10*a* and 11*a* on their mating surfaces. The wedge profiles are spring biased together by the force of a compression spring 12, whereby the radial position of the extending plate 11 is maintained in the retracted position by the force of the pivoting plate wedge 10*a* upon the extending plate wedge 11*a*. The compression spring 12 is confined within a spring retainer 13, which further includes a sliding lever 14. The sliding positions of the lever 14 alternatively compress (See FIG. 6) and release (See FIG. 7) the compression spring 12. When released, the compression spring 12 axial force is applied to the pivoting plate 10, to bias it against the extending plate 11. The released position of the compression spring 12 corresponds to the retracted position of the extension plate 11, as shown in FIGS. 5 and 7. Accordingly, when the compression spring 12 is compressed, the extending plate 11 is freed from contact with the pivoting plate 10 and rapidly assumes the extended position (See FIGS. 4 and 6). The extending plate 11 is connected at its base 11*b* to a main spring 15, which exerts an outward force on the extending plate 11 tending to cause the extending plate to be pushed upward when not restrained by the wedge face contact with the pivoting plate 10. The pop-up visual indicator 16 is connected to the upper end of the extending plate 11 so that it may transition from a retracted position at which the pop-up visual indicator 16 substantially retracts into the recess 1*d*, to an extended position at which it substantially extends outwardly from the recess 1*d* when the extending plate 11 is pushed upward at the expiration of the desired time interval. In the preferred embodiment in which the housing 1 has a shape of a toaster, the pop-up visual indicator 16 has the shape of a slice of bread. But it may have other shapes in another embodiment for a whimsical, advertizing or other display purpose. Further, as shown in FIG. 3 in the preferred embodiment, the pop-up visual indicator 16 extends out of or retracts into the recess 1*d* along an axis II that is substantially perpendicular to the axis I about which the dial knob 3 rotates.

In summary, when the primary gear 7 is meshed with the secondary gear 9 and the dial knob 3 is rotated, both the audio signal and visual signal generating mechanisms are energized by the timing mechanism. As the timing device reaches expiration of the desired time interval, the second smaller winding spring unwinds, resulting in the audio signal as tbe hammer strikes the bell housing. Concurrently, the curved end 8*a* of the secondary shaft 8 is rotated to a position where it presses upon the lever 14 thereby sliding the lever 14 to the position wherein the compression spring 12 is compressed. In this position, the extending plate 11 is free to extend from the housing and is motivated to do so by the outward radial force of the main spring 15. In this manner, both the audio signal and the visual signal are activated upon expiration of the desired time interval.

In some embodiment, the primary and secondary gears 7 and 9, respectively, may assume two alternative positions, whereby the primary gear 7 may be meshed with the secondary gear 9 in the first position and may be out of contact with and not meshed with the secondary gear 9 in the second position. This may be accomplished by any number of devices, such as sliding the gears in and out of mesh manually by means of a switch or lever. In such a configuration, one or both of the primary and secondary gears may slide axially on its shaft by means of splines or similar acting mechanisms. In this embodiment, the user may select to energize only the audio signal generating mechanism by having the two gears meshed, or may mesh the gears or otherwise synchronize these mechanisms so as to concurrently energize both the audio and visual signal generating mechanisms.

The outer surfaces of the timing device, having relatively smooth surfaces, are well-suited for application of art work, logos and graphics for advertising and promotional purposes.

What is claimed is:

1. A device comprising a controlling mechanism, a releasing mechanism including a primary and a secondary output signal mechanisms, and a housing;

said controlling mechanism comprising a rotating main shaft having an inboard end connected to a winding spring and an outboard end attached to a dial knob located outside the housing, the main shaft being axially affixed to a first gear proximate the outboard end but inside the housing; whereby turning the dial knob winds the winding spring to energize the primary output signal mechanism and simultaneously rotates the first gear in the direction of dial knob rotation, and subsequent release of the knob permits controlled unwinding of the winding spring with consequent rotation of the main shaft and dial knob to the point of relaxing of the winding spring;

said secondary output signal mechanism comprising a second gear rotatably meshed with said first gear and axially affixed on a generally flat rectangular secondary shaft, the secondary shaft being oriented parallel to the main shaft and having an inboard end and an outboard end, with the inboard end of the secondary shaft extending inward into a central cavity in the housing and having a curved portion proximate its inboard end, and said outboard end of the secondary shaft truncated proximate a front outer surface of the second gear;

the curved portion of the secondary shaft being rotatably engaged to a lever arm, such that when the winding spring is in a fully unwound position, the curved portion presses upon the lever arm to displace the lever arm, and thereby, compressing a compression spring, and when the winding spring is partially to frilly wound, the curved portion is not in contact with the lever arm and the compression spring is fully extended to apply a force upon a pivoting plate;

said compression spring, when extended, causing said pivoting plate against an extending plate with the relative positions of the plates maintained by means of engaging wedge blocks comprising a first wedge block located on the mating surface of the pivoting plate and a second engaging wedge block located on the mating surface of the extending plate;

said extending plate being axially connected, at an inner end thereof, to an end of a main spring with an opposite end of the main spring affixed to the inside bottom of the housing, such that the main spring exerts a radially outward force on the extending plate whereby when the lever arm compresses the compression spring to disengage the wedge blocks from each other, the extending plate will extend outwardly from the main spring due to the radially outward force of the main spring; and said extending plate is connected at an outer end thereof to at least one pop-up visual indicator whereby as the extending plate extends outwardly from the main spring, the at least one pop-up visual indicator extends outward from the housing.

2. The device of claim 1 wherein the housing and the at least one pop-up visual indicator are in the configuration of a small toaster and slices of bread, respectively.

3. The device of claim 1 wherein the primary output signal mechanism and the secondary output signal mechanism are energized, for actuation thereof, by rotation of the knob.

4. The device of claim 1 wherein the primary output signal mechanism generates an audio signal.

5. The device of claim 1 further including printed or graphical imprinting on at least one outside surface thereof for the purpose of advertising or promotion.

6. The device of claim 4 wherein the audio signal is selected from the group consisting of bell, buzzer, beeper, clicker, music, and ring tones.

7. A timing device for alerting a user of expiration of a desired time interval via audio and visual signals, the device comprising:

a) a housing defining a recess on a first side surface thereof;

b) a knob disposed on a second side surface of the housing, the knob being rotatable about a first axis for manually setting the desired time interval therewith;

c) a timing mechanism encased in the housing and in mechanical communication with the knob for mechanically timing passage of time until the desired time interval expires;

d) an audio signal generating mechanism encased in the housing and in mechanical communication with the timing mechanism for generating the audio signal at the expiration of the desired time interval; and e) a visual signal generating mechanism comprising:

a pop-up visual indicator extendable out of and retractable into the recess along a second axis, the second axis being perpendicular to the first axis, an operation mechanism encased in the housing and in mechanical communication with the pop-up visual indicator, and an actuation mechanism encased in the housing and in mechanical communication with the timing mechanism and configured to actuate the operation mechanism at the expiration of the desired time interval, wherein, triggering the operation mechanism by the actuation mechanism causes the pop-up visual indicator to transition from a retracted position to an extended position, the pop-up visual indicator substantially retracting into the recess and substantially extending outwardly from the recess respectively.

8. The timing device of claim 7, wherein the timing mechanism comprises a first winding spring configured to be wound while the knob is rotated and unwound with a constant rate thereafter for timing passage of time.

9. The timing device of claim 8, wherein the audio signal generating mechanism is mechanically energized by the first winding spring in generating the audio signal.

10. The timing device of claim 9, wherein the audio signal generating mechanism comprises a second winding spring which is in mechanical communication with the first winding spring and configured to unwind at the expiration of the desired time interval so as to provide mechanical energy for generating the audio signal.

11. The timing device of claim 8, wherein the actuation mechanism establishes mechanical communication with the operation mechanism, for actuating the operation mechanism thereby, only at the expiration of the desired time interval.

12. The timing device of claim 11, wherein the actuation mechanism comprises a primary gear in mechanical communication with the first winding spring and a secondary gear meshed with the primary gear.

13. The timing device of claim 12, wherein the actuation mechanism further comprises a shaft connected to the secondary gear for establishing the mechanical communication with the operation mechanism thereby at the expiration of the desired time interval.

14. The timing device of claim 12, wherein the secondary gear is capable of being selectively meshed with the primary gear for selectively actuating the operation mechanism.

15. The timing device of claim 14, wherein the primary and secondary gears are in and out of mesh slidably by means of splines.

16. The timing device of claim 7, wherein the housing has, generally, a configuration of a box having six side surfaces including the first and second side surfaces, and the pop-up visual indicator has a configuration of a slice of bread.

17. A method of advertising comprising the steps of:

a) providing a timing device for alerting a user of expiration of a desired time interval via audio and visual signals, the device comprising:

1) a housing defining a recess on a first side surface thereof 2) a knob disposed on a second side surface of the housing, the knob being rotatable about a first axis for manually setting the desired time interval therewith, 3) a timing mechanism encased in the housing and in mechanical communication with the knob for mechanically timing passage of time until the desired time interval expires, 4) an audio signal generating mechanism encased in the housing and in mechanical communication with the timing mechanism for generating the audio signal at the expiration of the desired time interval, and 5) a visual signal generating mechanism comprising:

a pop-up visual indicator extendable out of and retractable into the recess along a second axis, the second axis being perpendicular to the first axis, an operation mechanism encased in the housing and in mechanical communication with the pop-up visual indicator, and an actuation mechanism encased in the housing and in mechanical communication with the timing mechanism and configured to actuate the operation mechanism at the expiration of the desired time interval, wherein, triggering the operation mechanism by the actuation mechanism causes the pop-up visual indicator to transition from a retracted position to an extended position, the pop-up visual indicator substantially retracting into the recess and substantially extending outwardly from the recess respectively; and b) disposing advertising material on an outer surface of the timing device.

* * * * *